US006074497A

United States Patent [19]

Inoue et al.

[11] Patent Number: 6,074,497

[45] Date of Patent: Jun. 13, 2000

[54] HIGHLY WEAR-RESISTANT ALUMINUM-BASED COMPOSITE ALLOY AND WEAR-RESISTANT PARTS

[75] Inventors: Akihisa Inoue, 11-806, Kawauchi-Jutaku, 35, Kawauchi-motohasekura, Aoba-ki, Sendai-shi, Miyagi-ken; Masahiro Oguchi, Nagano; Junichi Nagahora, Miyagi; Masato Otsuki; Toru Kohno, both of Saitama; Shin Takeda, Aichi; Yuma Horio, Shizuoka, all of Japan

[73] Assignees: Akihisa Inoue, Sendai, Japan; Teikoku Piston Ring Company Limited, Tokyo, Japan; YKK Corporation, Tokyo, Japan; Mitsubishi Materials Corporation, Tokyo; Yamaha Corporation, Hamamatu, both of Japan

[21] Appl. No.: 08/898,590

[22] Filed: Jul. 22, 1997

[30] Foreign Application Priority Data

Jul. 23, 1996 [JP] Japan ..... 8-211858

[51] Int. Cl.[7] ..... C22C 21/00

[52] U.S. Cl. ..... 148/403; 148/437; 428/614

[58] Field of Search ..... 148/403, 437; 428/614

[56] References Cited

U.S. PATENT DOCUMENTS

| | | | |
|---|---|---|---|
| 4,789,605 | 12/1988 | Kubo et al. | 428/614 |
| 5,217,816 | 6/1993 | Brupbacher et al. | 428/614 |
| 5,593,515 | 1/1997 | Masumoto et al. | 148/437 |
| 5,607,523 | 3/1997 | Masumoto et al. | 148/437 |
| 5,616,421 | 4/1997 | Sawtell et al. | 428/614 |
| 5,626,692 | 5/1997 | Rohatgi et al. | 148/437 |
| 5,851,317 | 12/1998 | Biner et al | 148/403 |

FOREIGN PATENT DOCUMENTS

| | | |
|---|---|---|
| 0 474 880 A1 | 3/1992 | European Pat. Off. . |
| 0 529 542 A1 | 3/1993 | European Pat. Off. . |
| 0 605 273 A1 | 7/1994 | European Pat. Off. . |
| 0 675 209 | 10/1995 | European Pat. Off. . |
| WO 94/01029 | 1/1994 | WIPO . |

OTHER PUBLICATIONS

Database WPI, Section Ch, Week 9624; Derwent Publications Ltd., London, GB; Class M26, AN 96–236443 & JP 8–92680 A, Apr. 9, 1996 (Abstract).

Terry & Jones: "Metal Matrix Composites—Current Developments & Future Trends In Industrial Research and Applications" 1990, Elsevier Advanced Technology, Oxford, UK; pp. 41, 45 & 46.

*Primary Examiner*—George Wyszomierski

*Attorney, Agent, or Firm*—Armstrong, Westerman, Hattori, Mcleland & Naughton

[57] ABSTRACT

A highly wear-resistant aluminum-based composite alloy has improved wear resistant itself and the wear amount of the opposed Fe-based material is decreased as compared with the conventional wear-resistant aluminum alloys. The inventive composite alloy has a structure that at least either a dispersing phase selected from the group consisting of hard fine particles or a solid-lubricant particles having average diameter of 10 um or less is dispersed in an aluminum-alloy matrix which contains quasi-crystals.

28 Claims, 3 Drawing Sheets

HIGHLY WEAR-RESISTANT ALUMINUM-BASED COMPOSITE ALLOY AND WEAR-RESISTANT PARTS

BACKGROUND OF INVENTION

1. Title of Invention

The present invention relates to a highly wear-resistant aluminum-based composite alloy, more particularly to application of a quasi-crystalline aluminum-based alloy, which has the features of high strength and hardness, to applications where wear resistance is required. The present invention also relates to wear-resistant aluminum-alloy parts having improved compatibility with steel materials.

2. Description of Related Art

Heretofore, the high-strength aluminum-based alloys have been produced by means of the rapid cooling and solidification methods, such as the melt-quenching method.

Particularly, the aluminum-based alloy produced by the rapid cooling and solidification method disclosed in Japanese Unexamined Patent Publication Hei 1-275,732 is amorphous or fine crystalline. The fine crystalline alloy disclosed specifically in this publication is composed of an aluminum solid-solution matrix, fine crystalline aluminum matrix, and stable or meta-stable intermetallic compounds.

The aluminum-based alloy disclosed in Japanese Unexamined Patent Publication Hei 1-275,732 is a high-strength alloy which has high hardness of from approximately Hv 200 to 1000, and tensile strength of from 87 to 103 kg/mm$^2$. The heat resistance is also improved since the crystallizing temperature is as high as 400K or higher. Furthermore, super-plasticity appears in this alloy at a high temperature where the fine crystalline phase is stable. The workability of this material is, therefore, satisfactory when its high strength is taken into consideration.

However, when the above mentioned aluminum-based alloy is exposed in a temperature region of 573K or more, the excellent properties of the material attained by the rapid cooling and solidification are impaired. There remains, therefore, room for improving the heat resistance, particularly the strength at high temperature. In addition, since the elements having relatively high specific gravity, such as Fe, Ni, misch metal and the like, are added up to 10 atomic % in the alloy of the above publication, there is no appreciable increase in specific strength. Furthermore, the high ratio of volume of the intermetallic compounds renders the ductility to be poor. Particularly, improvement of the elongation is required.

When the Al—Mn—Ce based aluminum-based alloy produced by the single-roll melt quenching method contains a solute element at a content exceeding a certain level, an fcc-Al solid solution plus icosahedral quasi-crystals are formed, and the tensile strength becomes as exceedingly high as from 535 to 1200 MPa (Seminar of Japan Society for Metals on 1993 "Nano-scale Structure Controlled Materials" (page 63) published Jan. 25, 1993).

The excellent wear resistance of the wear-resistant aluminum alloys known heretofore, i.e., the eutectic or hypereutectic Al—Si alloys, is attributable to the primary or eutectic Si dispersing structure in the Al matrix. However, since the coarseness of the primary Si crystals of the cast alloy is a few tens $\mu$m or more, the cast alloy is difficult to re-form, and even the casting itself is difficult. Not only such production problems but also the sliding problems have been pointed out, that is, the coarse primary Si excessively roughens the surface of the opposed material.

It is also known that the atomized Al-35% Si alloy, primary Si of which is finely dispersed due to rapid cooling, is subsequently worked by the powder-metallurgy method. The wear resistance of the powder alloy produced by this method is itself improved but wears off the opposed material greatly. In addition, since the powder alloy is brittle and of low strength, its use in wear-resistant parts exposed to heavy load is difficult.

SUMMARY OF INVENTION

It is, therefore, an object of the present invention to provide an aluminum-based alloy which has improved wear-resis-tance as compared with the conventional eutectic or hypereutectic Al—Si alloy.

In accordance with the present invention, there is provided an aluminum-based composite alloy, characterized in that the hard fine particles and/or solid-lubricant particles having average diameter of 10 $\mu$m or less are dispersed in the aluminum-alloy matrix which contains quasi-crystals.

The quasi-crystals are a kind of an Al-rich super-saturated quasi-periodic constituent phase. The quasi-crystals have excellent properties as structural materials, such as improved heat-resistance and improved strength at both room temperature and high temperature, high specific strength and ductility. In addition to these properties, the hardness of the Al quasi-crystals is as high as that of steel materials, that is, there is almost no difference in hardness between the aluminum and steel materials. When the Al quasi-crystals as the wear-resistant material and the steel materials as the opposed material are caused to slide against one another, wear due to the hardness difference seems to hardly occur. Evidently, the Al quasi-crystals have excellent seizure resistance in the case of the above sliding, because these crystals and the steel materials are of different kinds where seizure is inherently difficult to occur.

The Al quasi-crystals have a disordered atom arrangement in a short-range region and a regular icosahedron in a long-rangs region. The short range region is, typically approximately 1 nm or less, and the long-range region is typically approximately 2 nm or less.

The above-described outstanding features of the Al-quasi crystals are not fully demonstrated, when they are used alone as the sliding material, presumably because the quasi-crystals, structure of which is an Al-rich super-saturated quasi-periodic constituent phase, is liable to undergo structural change when exposed to high temperature, even if an adequate amount of lubricating oil is present between the quasi-crystals and the steel materials. The present inventors gave further consideration to this aspect. They discovered, then, that the above-described structural change can be suppressed (1) by means of dispersing the hard fine particles and quasi-crystals with one another so as to enhance the wear resistance; or (2) by means of dispersing the solid-lubricant fine particles and quasi-crystals with one another so as to decrease the friction force and hence the heat generation; or by both means.

These fine particles must be 10 $\mu$m or less in average. Coarser hard particles decrease the strength and machinability of the aluminum-based alloy and exessively wear off the opposed material. The hard particles herein indicate the particles having essentially higher hardness than the opposed material of the aluminum-based composite alloy according to the present invention. Since the opposed material is normally an Fe-based material usually having a hardness of from approximately Hv 200 to 450, the particles are essentially harder than this value. Usually, the hard particles are selected from the metallic Si, an eutectic or hyper-eutectic Al—Si alloy, oxide, carbide, nitride, boride and the like. Preferably, $Al_2O_3$, $SiO_2$, $TiO_2$ and the like are selected as the oxide; WC, SiC, TiC and the like are selected as the carbide; TiN, $Si_3N_4$, AlN and the like are selected as the nitride; and, $TiB_2$ and the like is selected as the boride.

The solid lubricant is known per se for example in KIRK-OTHMER Concise Encyclopedia of Chemical Technology (Japanese Edition published Nov. 30, 1990) (c.f. items "solid-film lubricants" on page 593). Preferably, graphite, BN, $MoS_2$, $WS_2$, polytetrafluoroethylene and the like are selected as the solid lubricant.

These fine particles should be dispersed in an amount of from 5 to 30% by weight, because at a dispersion amount of less than 5% the wear-resistance is poor, while at a dispersion amount of more than 30% the strength and ductility of the composite alloy becomes so low that the fine particles separate off during sliding. This results not only in the wear of the composite alloy itself but also in increase in the wear of the opposed material.

The composition of the above-described quasi-crystals is not specifically limited at all, provided that it has a disordered atom arrangement in a short-range region and has a polyhedral shape, e.g., regular icosahedral form in a long-range region.

The particularly preferable aluminum-based alloy has a composition which is expressed by the general formula $Al_{bal}Q_aM_bX_c$, in which Q is at least one element selected from the group consisting of Cr, Mn, V, Mo and W, M is at least one element selected from the group consisting of Co, Ni and Fe, X is at least one element selected from the group consisting of Ti, Zr, Hf, Nb, a rare-earth element including Y (yttrium) and misch metal (Mm), and "a", "b" and "c" are atomic % and $1 \leqq a \leqq 7$, $0.5 \leqq b \leqq 5$, and $0 \leqq c \leqq 5$, respectively.

In the above-mentioned formula $Al_{bal}Q_aM_bX_c$, the Q element is at least one element selected from the group consisting of Cr, Mn, V, Mo and W, and is indispensable for forming the quasi-crystals. In addition, when the Q element is combined with the M element described hereinbelow, such effects are attained that the formation of quasi-crystals is facilitated and the thermal stability of alloy-structure is enhanced.

The M element is at least one element selected from the group consisting of Co, Ni and Fe, and attains, when combined with the Q element, such effects that the formation of quasi-crystals is facilitated and the thermal stability of the alloy-structure is enhanced. The M element has a low diffusing ability in Al which is a principal element and, hence, effectively strengthens the Al matrix. The M element forms with the Al, which is a principal element, and with the other elements, various intermetallic compounds which enhance the strength of the alloy and contributes to the heat resistance.

The X element is at least one element selected from the group consisting of Ti, Zr, Hf, Nb, a rare-earth element including Y (yttrium) and misch metal (Mm). These elements effectively enlarge the quasi-crystal formation region to a low solute-concentration site of the additive transition element. The cooling effect, which brings about refining of the alloy structure, is enhanced by the X element. The mechanical strength and specific strength as well as the ductility are, therefore, enhanced by addition of the X element. La and/or Ce are preferable as the rare-earth element. A preferable misch metal is a mixture of one or more rare-earth elements, such as La, Ce, Nd and Sm and from 0.1 to 10% by weight of one of Al, Ca, C, Si and Fe.

Strength at room temperature and at high temperature of 300° C. or more as well as hardness of the $Al_{bal}Q_aM_bX_c$ alloy with a=1–7 atomic %, b=0.5–5 atomic %, c=0% or ≦5% are higher than those of the commercially available conventional high-strength aluminum-alloys. Improvement in the wear-resistance is, therefore, expected. When the Q, M and X elements of the $Al_{bal}Q_aM_bX_c$ alloy lie within the above described ranges, the ductility level of the alloy enables to withstand the practical working to work the inventive alloy into parts having various shapes without relying on a casting process.

The powder, in which the hard fine-particles and/or solid-lubricant fine-particles are dispersed, can be subjected to compacting, followed by extrusion. Plastic deformation of the inventive alloy powder during the working, such as compacting followed by extrusion can enhance the strength of bonding between the fine particles and the matrix. Since the inventive alloy is ductile as mentioned above, the powder deforms easily and hence the bonding strength is enhanced. The heat resistance of the alloy is necessary for maintaining the quasi crystalline structure of matrix after bonding.

In order to fulfill all of the requirements mentioned above, 3 atomic % $\leqq (a+b+c) \leqq 8$ atomic % is particularly preferable.

The $Al_{bal}Q_aM_b$ alloy (i.e., c=0 of the above mentioned general formula) can have the same properties as the high-strength $Al_{bal}Q_aM_bX_c$ alloy, provided that a=1–7 atomic % and b=0.5–5 atomic %. The particularly preferable range is $3 \leqq (a+b) \leqq 12$ atomic %.

The matrix structure may be composed of (a) quasi-crystals and (b) one or more of an amorphous phase, aluminum-crystals and a super-saturated solid-solution of aluminum. The intermetallic compounds of Al and one or more of the additive elements and/or the intermetallic compounds of the additive elements may be contained in the respective structure (phase) of the matrix constituent structure (phase) (b). The intermetallic compound present in (b) is effective for strengthening the matrix and controlling the crystal grains.

In the matrix structure of the alloy according to the present invention the quasi-crystals may be finely dispersed in the amorphous phase, aluminum phase and/or the super-saturated solid-solution phase of aluminum. The quasi-crystals and occasionally present, various intermetallic compounds preferably have an average particle-size of from 10 to 1000 nm. The intermetallic compounds having an average particle-size of less than 10 nm do not easily contribute to strengthening the alloy. When such intermetallic compounds are present in the alloy in an appreciable amount, there arises a danger of alloy embrittlement. The intermetallic compounds having an average particle-size of more than 1000 nm are too coarse to maintain the strength and involves the possibility of losing the function as a strengthening element.

The average inter-particle spacing between the quasi-crystals and the occasionally present intermetallic compounds is preferably from 10 to 500 nm. When the average inter-particle spacing is less than 10 nm, strength and hardness of the alloy are high but the ductility is not satisfactory. On the other hand, when the inter-particle spacing exceeds 500 nm, the strength is drastically lowered. High strength-alloy may, thus, not be provided.

Since the quasi-crystals have a disordered atom-arrangement in a short-range region of approximately of 1 nm or less, and is an Al-rich phase, the ductility is excellent. High Young modulus, strength at high temperature and room temperature, ductility and fatigue strength are provided by the matrix having the composition as given in the above mentioned general formula.

A method for obtaining an aluminum-based alloy, which has a quasi-crystalline structure or a composite structure of the quasi-crystals and an amorphous phase or the like, is per se known in the above referred "Nano-Scale Structure Controlled Materials" and its references. An alloy having the above mentioned structure can be obtained also by means of subjecting the alloy melt having the above composition to the melt-quenching method, such as a single roll method, a twin roll method, various atomizing methods and spraying method. Rapid cooling is carried out in these methods within a cooling rate in the range of from approximately $10^2$ to $10^4$K/sec, although the cooling rate somewhat varies depending upon the composition. The quasi-crystals can be formed as well by forming the super-saturated Al solid solution by means of first rapid cooling and then heating it to precipitate the quasi-crystals.

The volume ratio of the quasi-crystals in the matrix structure is preferably 15% or more, because the wear resistance is not satisfactory at less than 15%. On the other hand, since the workability of quasi-crystals is inferior to that of pure Al, when the volume ratio of quasi-crystals exceeds 80%, there arises a possibility that the working condition becomes so severe that satisfactory working can not be carried out. The volume ratio of quasi-crystals in the alloy structure is more preferably from 50 to 80%.

In the aluminum-based matrix alloy and the composite alloy according to the present invention, the alloy structure, i.e., the quasi-crystals, and the particle-diameter and dispersing state of the respective phases can be controlled by selecting the production conditions. The strength, hardness, ductility and heat resistance can be adjusted by means of the above controlling method.

Improved super-plasticity can be imparted to the above described materials, when the size of quasi-crystals in the matrix and various intermetallic compounds are controlled in the range of from 10 to 1000 nm, and further the average inter-particle spacing is in the range of 10 to 500 nm.

The rapidly solidified material produced by the above described method is crushed to an average particle size of from 10 to 100 $\mu$m. This crushed powder or the rapidly solidified powder is mixed with hard particles such as Si (or Al—Si alloy particles), oxide, carbide, nitride, boride or the like and/or lubricant particles such as graphite, BN, $MoS_2$, $WS_2$, polytetrafluoroethylene or the like, by means of a ball mill or the like, thereby uniformly dispersing the fine particles. The mixture material obtained by these methods is subjected to compacting and hot-working such as extrusion. The hot-working temperature is from 300 to 600° C. but is preferably from 400° C. or lower when polytetrafluoroethylene is used.

The wear-resistant parts, which comprise the aluminum-based composite alloy, can be used in machines, to be in slidable contact with Fe-based material. The wear-resistant parts according to the present invention have the following advantages.

(1) The wear-resistant parts are not only wear-resistant against the opposed Fe-based material but also the wear of the Fe-based material is minimized.

(2) The wear-resistant parts can be formed not by the casting but also by the powder-metallurgical method.

(3) Seizure is difficult to occur.

(4) The wear-resistant parts can used in an application where the load applied is high.

The present invention is hereinafter described by way of the examples with reference to the drawings.

EXAMPLE 1

Figure 1A:
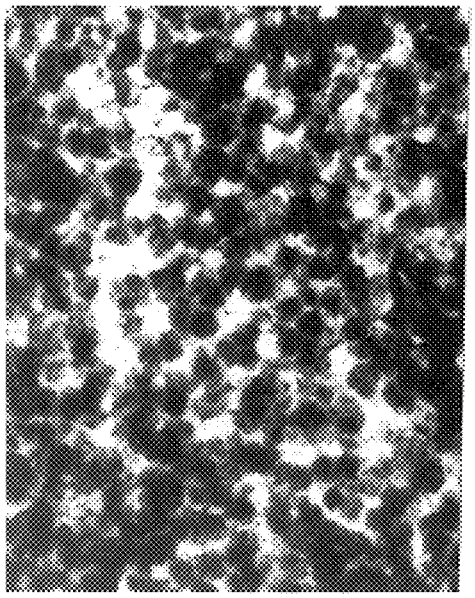
FIGS. 1(*a*) and 1(*b*) are photographs showing the metal structure of Example 1 by TEM observation and electron diffraction.
Figure 1B:
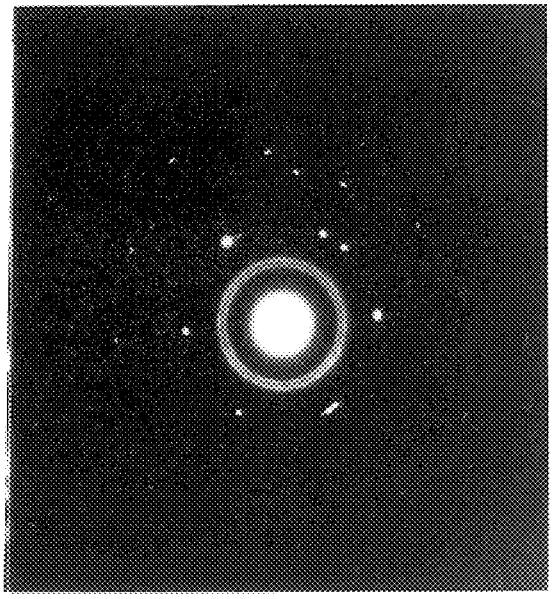

The mother alloy, composition of which is shown by $Al_{94}Cr_{2.5}Co_{1.5}Ce_1Zr_1$ (atom ratio), was melted in a high-frequency melting furnace. Powder having average particle size of 30 $\mu$m was then produced by the high-pressure gas spraying method (Ar gas) under gas pressure of 40 kg/cm$^2$. The produced powder was subjected to TEM observation and electron-ray diffraction. The results shown in FIG. 1 revealed that the alloy had mixed phases of a quasi-crystalline phase and an aluminum phase. From FIG. 1, it is seen that the quasi-crystalline phase is of approximately 30 nm diameter and is uniformly dispersed in the aluminum phase (white portions of the structure). The volume ratio of quasi-crystals is 68%, and, hence the quasi-crystals are the main phase of the alloy structure. With this powder was mixed 10% by weight of SiC powder having average particle-diameter of 3 $\mu$m by means of a ball mill for 3 hours.

The powder, which was produced by the above mentioned method, was filled in a capsule made of copper and vacuum-evacuated ($1\times10^{-6}$ torr) at 360° C. Warm extrusion was carried out at 360° C. at extrusion ratio of 10 to form a round rod. The structure of this round rod was such that SiC particles were uniformly and finely dispersed in the aluminum-alloy matrix which included the dispersed quasi-crystals.

EXAMPLE 2

The composite alloys having the composition shown in Table 1 were extruded by the same method as in Example 1. Hardness, tensile strength and elongation of the bulk materials at room temperature were examined. The results are shown in Table 1.

TABLE 1

| No. | Alloy Composition of Matrix (at %) | Dispersing Particles Kind | Additive Amount (wt %) | Particle Diameter (nm) | Hardness (Hv) | Tensile Strength (γ) (MPa) | Elongation (%) |
|---|---|---|---|---|---|---|---|
| Inventive Example | | | | | | | |
| 1 | $Al_{94}Cr_{2.5}Co_{1.5}Ce_1Zr_1$ | SiC | 5 | 3 | 210 | 550 | 13 |
| 2 | $Al_{94}Cr_{2.5}Co_{1.5}Ce_1Zr_1$ | SiC | 10 | 3 | 218 | 540 | 9 |
| 3 | $Al_{94}Cr_{2.5}Co_{1.5}Ce_1Zr_1$ | SiC | 20 | 3 | 230 | 540 | 6 |
| 4 | $Al_{94}Cr_{2.5}Co_{1.5}Ce_1Zr_1$ | SiC | 30 | 3 | 233 | 525 | 4 |
| Comparative Example | | | | | | | |
| 1 | $Al_{94}Cr_{2.5}Co_{1.5}Ce_1Zr_1$ | SiC | 35 | 3 | 250 | 430 | 0.5 |
| 2 | $Al_{94}Cr_{2.5}Co_{1.5}Ce_1Zr_1$ | SiC | 10 | 20 | 270 | 490 | 3 |
| 3 | $Al_{94}Cr_{2.5}Co_{1.5}Ce_1Zr_1$ | — | — | — | 205 | 560 | 24 |
| 4 | $Al_{94}Cr_{2.5}Co_{1.5}Ce_1Zr_1$ | SiC | 2 | 3 | 210 | 545 | 15 |
| Inventive Example | | | | | | | |
| 5 | $Al_{93.5}Mn_3Ni_{1.5}Ia_1Hf_1$ | SiC | 5 | 3 | 230 | 505 | 9 |
| 6 | $Al_{93}Mn_{1.5}Co_{2.5}Ce_2Ti_1$ | BN | 10 | 1 | 200 | 520 | 7 |
| 7 | $Al_{93}V_3Co_2Ce_1Zr_1$ | BN | 10 | 1 | 198 | 515 | 7.5 |
| 8 | $Al_{94}Mn_{1.5}Co_{2.5}Ce_1Ti_1$ | $MoS_2$ | 5 | 0.5 | 210 | 480 | 8 |
| 9 | $Al_{94}Mn_{2.5}Co_{1.5}Mm_1Zr_1$ | $Ws_2$ | 5 | 1 | 202 | 485 | 5 |
| 10 | $Al_{94}Mn_{2.5}Co_{1.5}Mm_1Zr_1$ | Polytetra fruolo-ethylene | 5 | 2 | 202 | 515 | 9 |
| 11 | $Al_{95}Mo_2Co_{1.5}Ce_{0.5}Zr_1$ | C + SiC | 10 | 3 | 225 | 495 | 4.5 |
| 12 | $Al_{95}Cr_{2.5}Fe_1Mm_1Zr_{0.5}$ | C + SiC | 10 | 3 | 238 | 520 | 6 |
| 13 | $Al_{93.5}Mn_3Cu_{1.5}Y_2$ | $Si_3N_4$ | 20 | 1 | 245 | 490 | 5.5 |
| 14 | $Al_{94.5}V_3Fe_{1.5}Mm_1$ | $Si_3N_4$ | 20 | 1 | 253 | 485 | 4 |
| 15 | $Al_{94}Cr_3Co_2Ce_1$ | $Al_2O_3$ | 10 | 0.5 | 220 | 490 | 7 |
| 16 | $Al_{93}Mn_5Fe_2$ | $TiB_2$ | 5 | 1 | 234 | 505 | 3.5 |
| 17 | $Al_{92}Cr_6Co_2$ | SiC | 15 | 3 | 245 | 483 | 3.5 |
| 18 | $Al_{94}Cr_{2.5}Co_{1.5}Ce_1Zr_1$ | Si | 10 | 1 | 210 | 515 | 6.5 |
| 19 | $Al_{94}Cr_2Ni_2Mm_1Nb_1$ | C + SiC | 20 | 3 | 235 | 520 | 5.5 |
| 20 | $Al_{94.5}Mo_3Co_{1.5}Ce_1$ | Si | 10 | 1 | 220 | 515 | 7 |
| 21 | $Al_{94}Mo_4Ni_1Y_1$ | $TiB_2$ | 10 | 1 | 247 | 520 | 8 |
| 22 | $Al_{93.5}Mn_{2.5}Fe_1Mm_1Ti_2$ | $MoS_2$ | 10 | 0.5 | 210 | 485 | 6.5 |
| 23 | $Al_{94}Mn_3Ni_1Mm_1Zr_1$ | $Al_2O_3$ | 10 | 0.5 | 225 | 505 | 7.5 |
| 24 | $Al_{93.5}Cr_1Co_2Mm_{2.5}Hf_1$ | C + $Al_2O_3$ | 20 | 1 | 235 | 500 | 5.5 |
| Comparative Example | | | | | | | |
| 5 | I/M A390 Tb | — | — | — | 95 | 425 | — |

EXAMPLE 3

Figure 2:
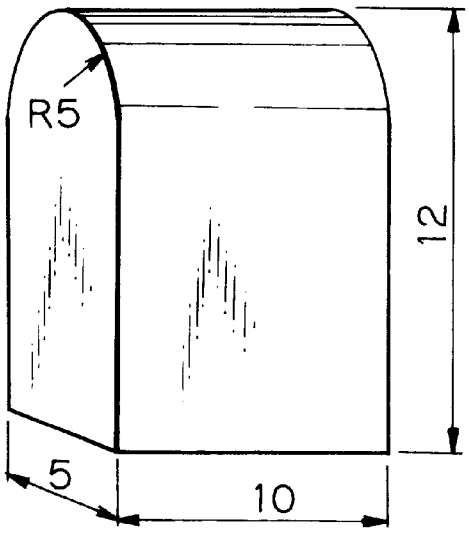
FIG. 2 is a drawing of a wear-test specimen.
Figure 3:
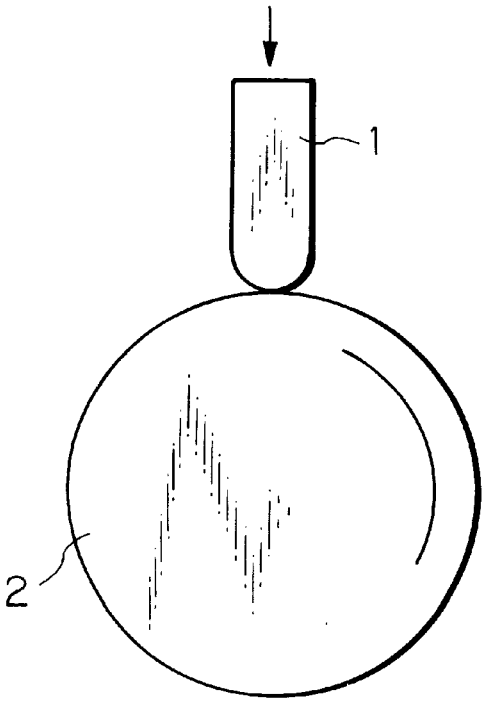
FIG. 3 is a drawing for illustrating the wear-test method.
Figure 4:
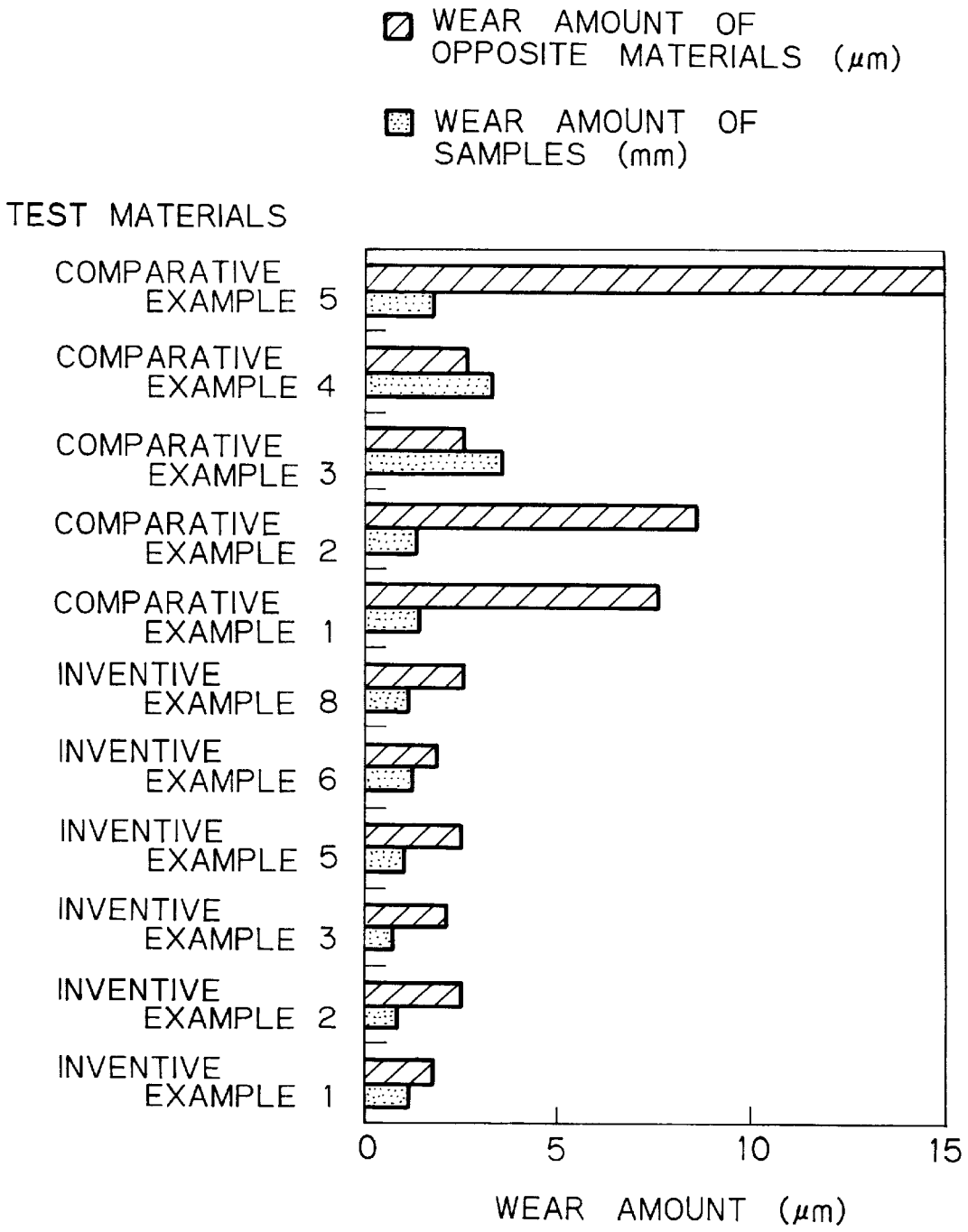
FIG. 4 is a graph showing the results of wear test in Example 3.

The extruded material of Inventive Example 2 was shaped as shown in FIG. 2. The shaped material 1 was then brought into contact with the opposing material 2 (eutectic cast iron, hardness Hv=520, 30 mm in diameter and 8 mm thick) as shown in FIG. 3. The wear test was carried out under the conditions: load of 10 kgf/mm; speed of 1 m/s; lubricating oil—ice machine oil (specifically Nisseki Lef Oil (NS-4GS, trade name); and, test duration of 20 minutes. The results are shown in FIG. 4. With regard to the evaluation of wear amount, the width of wear mark was measured for the tested specimens. For the opposing materials, a pressing indent was formed by a Vickers tester (load of 1 kg), the diameter of the indent was measured before and after the wear test, and the difference in the indent diameters was judged as the wear amount.

The Comparative Example 5 corresponds to A390 known as a wear-resistant alloy. The opposing materials of Comparative Examples 1, 2 and 5 are greatly worn off. The test specimens of Comparative Examples 3 and 4 themselves were greatly worn off. On the contrary, in the case of Inventive Examples the wear amount of both the specimens per se and the opposing materials is small. It is thus clear that the inventive materials have improved compatibility with the opposing materials.

As is described hereinabove, the room-temperature hardness, strength, elongation and heat resistance of the aluminum-based alloy can be improved by the quasi-crystals contained in the alloy. High specific strength materials can be provided by adding a small amount of a rare-earth element to the aluminum-based alloy containing the quasi-crystals, because strength can be enhanced while maintaining the specific gravity at a low level. Fine hard particles and/or a solid lubricant are added to the matrix consisting of an aluminum alloy consising of the quasi-crystals, thereby attaining improvement in the wear resistance. Although the composite alloy according to the present invention is exposed to thermal influence during the working for dispersing the fine particles, the excellent properties of the quasi-crystals can be maintained.

What is claimed is:

1. A highly wear-resistant aluminum-based composite alloy, comprising a dispersing phase selected from the group consisting of hard fine particles or solid-lubricant particles having average diameter of from 2 to 10 μm dispersed in an aluminum-alloy matrix which contains quasi-crystals.

2. A highly wear-resistant aluminum-based composite alloy according to claim 1, wherein said quasi-crystals have a regular icosahedral shape in a long-range region of approximately 2 nm or more.

3. A highly wear-resistant aluminum-based composite alloy according to claim 2, wherein said quasi-crystals have a disordered atom arrangement in a short-range region of approximately 1 nm or less.

4. A highly wear-resistant aluminum-based composite alloy according to claim 1, 2 or 3, wherein said dispersing phase comprises hard fine particles, and said hard particles are selected from the group consisting of metallic Si, an eutectic or hyper-eutectic Al—Si alloy, oxide, carbide, nitride, and boride.

5. A highly wear-resistant aluminum-based composite alloy according to claim 4, wherein said oxide is selected from the group consisting of $Al_2O_3$, $SiO_2$ and $TiO_2$.

6. A highly wear-resistant aluminum-based composite alloy according to claim 4, wherein said carbide is selected from the group consisting of WC, SiC and TiC.

7. A highly wear-resistant aluminum-based composite alloy according to claim 4, wherein said nitride is selected from the group consisting of TiN, $Si_3N_4$ and AlN.

8. A highly wear-resistant aluminum-based composite alloy according to claim 4, wherein the dispersing amount of the fine particles is from 5 to 30% by weight.

9. A highly wear-resistant aluminum-based composite alloy according to claim 1, 2 or 3, wherein said matrix has a composition which is expressed by the general formula $Al_{bal}Q_aM_bX_c$, in which Q is at least one element selected from the group consisting of Cr, Mn, V, Mo and W, M is at least one element selected from the group consisting of Co, Ni and Fe, X is at least one element selected from the group consisting of Ti, Zr, Hf, Nb, a rare-earth element including Y and misch metal (Mm), and "a", "b" and "c" are atomic % and $1 \leqq a \leqq 7$, $0.5 \leqq b \leqq 5$, and $0 \leqq c \leqq 5$, respectively.

10. A highly wear-resistant aluminum-based composite alloy according to claim 9, wherein said dispersing phase comprises hard fine particles, and said hard particles are selected from the group consisting of metallic Si, an eutectic or hyper-eutectic Al—Si alloy, oxide, carbide, nitride, and boride.

11. A highly wear-resistant aluminum-based composite alloy according to claim 10, wherein the dispersing amount of the fine particles is from 5 to 30% by weight.

12. A highly wear-resistant aluminum-based composite alloy according to claim 10, wherein said matrix contains the quasi-crystals and at least one phase selected from the group consisting of amorphous phase, aluminum crystals and super-saturated solid solution of aluminum.

13. A highly wear-resistant aluminum-based composite alloy according to claim 12, wherein said matrix further contains at least one intermetallic compound selected from the group consisting of first intermetallic compound of aluminum and one or more additive elements selected from Q, M and X and second intermetallic compound of one or more additive elements selected from Q, M and X.

14. A highly wear-resistant aluminum-based composite alloy according to claim 13, wherein the quasi-crystals and the intermetallic compounds have an average-particle size of from 10 to 1000 nm.

15. A highly wear-resistant aluminum-based composite alloy according to claim 12, wherein the volume ratio of the quasi-crystal in the matrix is from 15 to 80%.

16. A highly wear-resistant aluminum-based composite alloy according to claim 10, wherein said matrix further contains intermetallic compounds and an average particle distance between any one of the quasi-crystals and the intermetallic compounds is from 10 to 500 nm.

17. A highly wear-resistant aluminum-based composite alloy according to claim 10, wherein said oxide is selected from the group consisting of $Al_2O_3$, $SiO_2$ and $TiO_2$.

18. A highly wear-resistant aluminum-based composite alloy according to claim 10, wherein said carbide is selected from the group consisting of WC, SiC and TiC, said nitride is selected from the group consisting of TiN, $Si_3N_4$ and AlN.

19. A highly wear-resistant aluminum-based composite alloy according to claim 10, wherein said dispersing phase comprises solid-lubricant particles, and said solid-lubricant particles are selected from the group consisting of graphite, BN, $MoS_2$, $WS_2$ and polytetra-fluoroethylene.

20. Wear-resistant parts comprising the highly wear-resistant aluminum-based composite alloy according to claim 19.

21. A highly wear-resistant aluminum-based composite alloy according to claim 10, wherein said dispersing phase comprises oxide, and said oxide is selected from the group consisting of $Al_2O_3$, $SiO_2$ and $TiO_2$.

22. A highly wear-resistant aluminum-based composite alloy according to claim 10, wherein said dispersing phase comprises carbide and said carbide is selected from the group consisting of WC, SiC and TiC.

23. A highly wear-resistant aluminum-based composite alloy according to claim 10, wherein said dispersing phase comprises nitride, and said nitride is selected from the group consisting of TiN, $Si_3N_4$ and AlN.

24. A highly wear-resistant aluminum-based composite alloy according to claim 9, wherein in the general formula, $3 \leqq a+b+c \leqq 8$.

25. A highly wear-resistant aluminum-based composite alloy according to claim 9, wherein in the general formula, $c=0$, and $3 \leqq a+b \leqq 12$.

26. Wear-resistant parts comprising the highly wear-resistant aluminum-based composite alloy according to claim 9 in slidable contact with an Fe-based material.

27. A highly wear-resistant aluminum-based composite alloy according to claim 1, wherein said dispersing phase comprises solid-lubricant particles and said solid-lubricant particles are selected from the group consisting of graphite, BN, $MoS_2$, $WS_2$ and polytetra-fluoroethylene.

28. Wear-resistant parts comprising the highly wear-resistant aluminum-based composite alloy according to claim 1 in slidable contact with an Fe-based material.

* * * * *